United States Patent [19]

Strongin et al.

[11] 4,070,790

[45] Jan. 31, 1978

[54] DOLL WITH RELEASABLY-ATTACHED HAIR PIECES

[75] Inventors: Ned Strongin, Baldwin; Isabel Garrett, New York, both of N.Y.

[73] Assignee: Ned Strongin Associates, Inc., New York, N.Y.

[21] Appl. No.: 696,406

[22] Filed: June 15, 1976

[51] Int. Cl.[2] ..... A63H 3/44

[52] U.S. Cl. ..... 46/172

[58] Field of Search ..... 46/172; 132/53

[56] References Cited

U.S. PATENT DOCUMENTS

| | | | |
|---|---|---|---|
| 3,156,999 | 11/1964 | Dean et al. | 46/172 |
| 3,279,122 | 10/1966 | Blenner | 46/172 X |
| 3,385,305 | 5/1968 | Buzzelli | 132/53 |
| 3,476,122 | 11/1969 | Zaupa | 132/53 |
| 3,495,603 | 2/1970 | Young | 132/53 |
| 3,765,123 | 10/1973 | Terzian | 46/172 |

FOREIGN PATENT DOCUMENTS

| | | | |
|---|---|---|---|
| 993,784 | 7/1951 | France | 46/172 |

*Primary Examiner*—F. Barry Shay

*Attorney, Agent, or Firm*—Edward F. Levy

[57] ABSTRACT

A doll is provided with a doll head adapted to receive and releasably mount interchangeable hair pieces. The doll head is formed with a recessed groove sized and shaped to mount therein a plastic clip which extends centrally along the upper portion of the crown of the doll head and along the rear and side portions of the crown. The outer surface of the clip is covered by an array of fastening hooks or loops, and each separate hair piece also is provided with an array of complementary hooks or loops so arranged that the hair piece will adhere to a selected portion of the clip when pressed thereagainst. The doll head may be provided with permanent rooted hair of sufficient length to cover the clip and conceal the latter from view.

10 Claims, 5 Drawing Figures

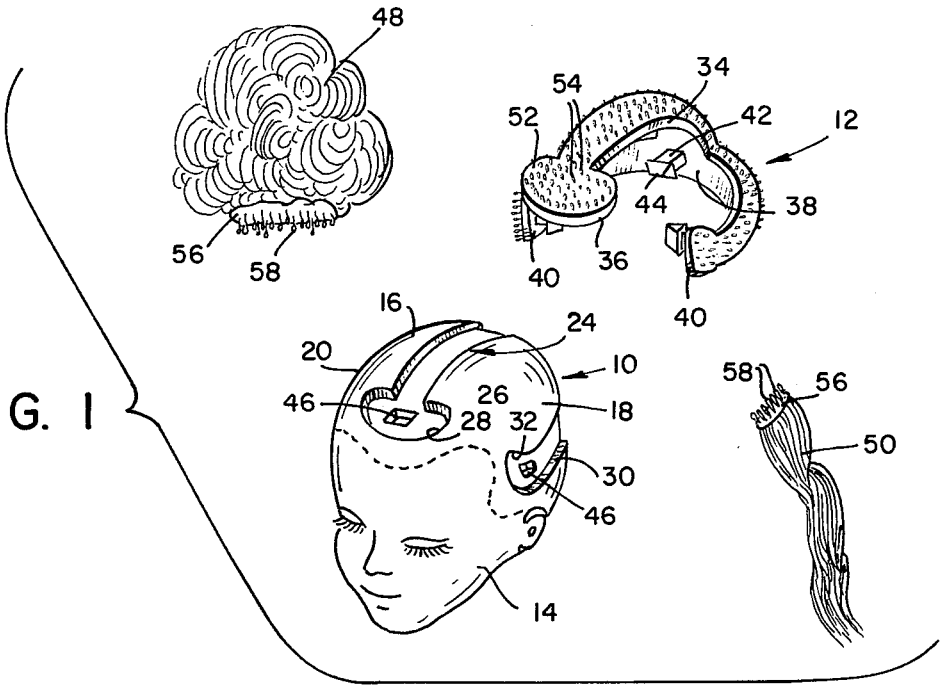
FIG. 1
FIG. 3
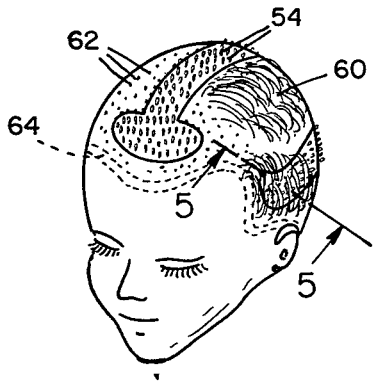
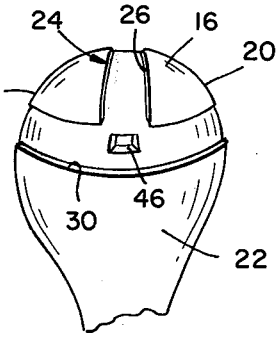
FIG. 2
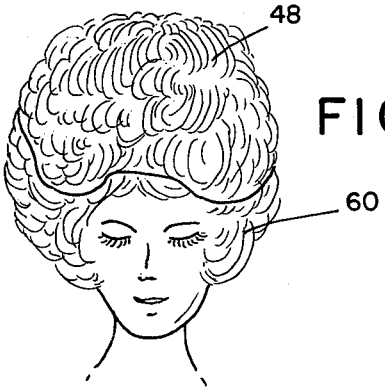
FIG. 4
FIG. 5
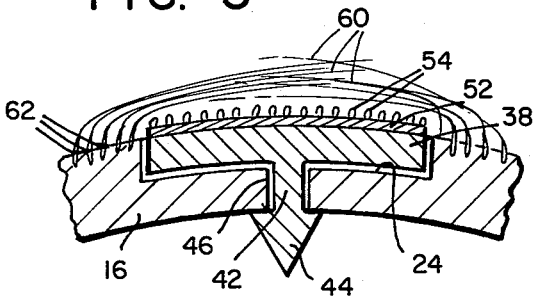

DOLL WITH RELEASABLY-ATTACHED HAIR PIECES

The present invention relates to improvements in dolls and in particular to a doll having a head adapted to releasably mount interchangeable hair pieces.

Conventional dolls are normally provided with wigs formed of artificial hair which is permanently secured to the doll head as by rooting. Dolls have also been provided with non-permanent wigs which could be entirely removed and replaced with another wig to change the hair coloring or styling. The construction of such removable wigs has been such, however, that the wigs fail to remain tightly positioned on the head after mounting, or are difficult to mount in proper position.

In the mannequin type dolls merchandised today, the trend is to simulate the styles and fashions in use by adults. The dolls are thus provided with clothing, accessories, hair styles and the like which are authentic reproductions of such items currently in vogue. One such current tendency in fashion is the use of artificial hairpieces such as falls, chignons, puffs of curls or the like which are attached to the natural hair of women to supplement and build up the hair style. Such supplemental hair pieces have not been heretofore provided for dolls, since the attachment of the hair pieces to the doll hair has been impractical.

It is an object of the present invention to provide a doll adapted to receive interchangeable hair pieces which may be easily attached to and removed from the doll head.

Another object of the invention is to provide a doll of the character described which includes a doll head having mounting means thereon and one or more hair pieces having complementary mounting means for selective attachment and removal of said hair pieces to the doll head, either as a hair piece which supplements the permanent wig of the doll, or as a complete, interchangeable wig.

Still another object of the invention is the provision of a doll of the character described in which the mounting means on the doll head and hair pieces are of such construction that the hair pieces may be easily and effectively attached and removed, and in mounted position the hair pieces are tightly retained and free from slippage.

A further object of the invention is the provision of a doll of the character described in which the mounting means on the doll head is a self-adhering fastening unit which may be covered over by the permanent hair of the doll so that it is not normally visible.

In accordance with the present invention there is provided a doll adapted to receive removable hair pieces and comprising a doll head having a crown portion with a clip mounted on the doll head and extending over the top, rear and sides of the crown portion. The doll also includes at least one hair piece and self-adhering fastening means on the clip and on the hair piece for releasably attaching the hair piece to a selected portion of the clip.

The clip comprises a first elongated band which extends across the center of the crown from the front of said crown to the rear thereof, and a second elongated band formed integrally with the rear end of the first band and extending perpendicularly thereto across the rear and sides of the crown. The doll head is formed with a recessed groove sized and shaped to receive the clip in a mounted position therein. The clip is covered with a self-adhering fastening assembly and each hair piece is provided with a complementary self-adhering fastening assembly of such construction that the assemblies grip together when a hair piece is pressed against an exposed portion of the clips.

Additional objects and advantages of the invention will become apparent during the course of the following specification when taken in connection with the accompanying drawings in which:

FIG. 1 is an exploded perspective view showing a doll head made in accordance with the invention, a clip adapted to be mounted on the doll head, and two hair pieces adapted to be attached to the clip;

FIG. 2 is a rear elevational view of the doll head of FIG. 1;

FIG. 3 is a front perspective view of the doll head of FIG. 1 with the clip shown in mounted position thereon, and a portion of the permanent doll hair shown rooted in the head;

FIG. 4 is a front elevational view of the doll head showing one of the hair pieces attached thereto and covering over the permanent doll wig; and FIG. 5 is an enlarged section taken along the line 5—5 of FIG. 3.

Referring in detail to the drawings, there is shown in FIG. 1 a doll head 10 made in accordance with the present invention and adapted to receive a clip 12 for removable attachment of hair pieces or sections.

The doll head 10 is hollow and is molded in the usual manner from a plastic such as polyvinyl chloride which is preferably flexible, to provide a face portion 14 with molded facial features, a crown portion 16, side portions 18 and 20, and a rear portion 22. The head 10 is molded with a continuous recessed groove or indentation 24 sized and shaped to receive the clip 12 in a manner to be presently described.

The recessed groove 24 has an upper section 26 which extends centrally over the crown portion 16 and partially down the rear portion 22 of the head 10, as shown in FIGS. 1 and 2, terminating at its forward end in an enlarged section 28 which is elongated in lateral directions and is located at the front of the crown portion 16 which corresponds to the doll hairline. At its rear end, the upper section 26 communicates with a rear section 30 disposed perpendicularly thereto, and extending transversely across the rear head portion 22. The opposite end portions of the rear section 30 extend around to the respective head side portions 18 and 20, and each terminates in an enlarged portion 32, one of which is shown in FIG. 1.

The clip 12 is also molded from plastic, a rigid plastic being preferable. The clip is formed with a configuration precisely matching that of the recessed groove 24 so that the clip will fit snugly within said groove, in the manner shown in FIG. 3. The clip 12 thus comprises an arcuate arm or band 34 terminating at one end in an enlarged portion 36 and at its other end with the center of an integral arcuate band 38, the ends of which terminate in enlarged portions 40. The band 34 and its enlarged terminal portion 36 fit snugly within the groove upper section 26 and the enlarged section 28, while the arcuate band 38 and its terminal enlarged portions 40 fit snugly within the groove rear section 30 and the enlarged terminal portions 32 thereof. For purposes of securing the clip 12 in mounted position within the recessed groove 24, the inner surface of said clip is formed with a plurality of integral locking tabs 42 having spear-shaped heads 44 of pyramidal configuration. The wall of the doll head 10 is formed with corresponding apertures 46 of smaller size than the heads 44, but of slightly larger size than the shanks of locking tabs 42. In the embodiment illustrated, a locking tab 42 is located on the inner surfaces of the enlarged portion 36, the junction between the bands 34 and 38, and each of the enlarged portions 40. Corresponding apertures 46 are located on the doll head within the groove enlarged section 28, the junction between the groove upper section 26 and rear section 30, and within each of the enlarged portions 32.

In mounting the clip 12 on the doll head 10, the clip is positioned in alignment with the recessed groove 24, in which aligned position, the locking tabs 42 are in registry with the corresponding apertures 46. The tabs are then pressed inwardly of the apertures 46, the latter yielding and expanding in size to permit the spear-shaped heads 44 of the tabs to pass entirely through the apertures to a position in which the heads 44 underlie the aperture and lock the clip 12 firmly in mounted position, as shown in FIG. 5.

FIG. 1 shows, by way of example, two auxiliary hair pieces 48 and 50, of different styles, which are intended to be attached to the doll head 10 at different locations thereon. For purposes of attachment of these hair pieces removably to the doll head, self-adhering fastening means are provided on the exposed outer surface of the clip 12 and upon each of hair pieces. Such fastening means is a commercial product sold under the trademark "Velcro", and consists of a first flexible strip or sheet having embedded therein an array of plastic loops, and a second flexible strip having embedded therein an array of plastic hooks. When the strips are placed face-to-face and pressed together, the hooks on the second strip engage and grip the loops on the first strip to releasably fasten the strips together.

The entire outer surface of the clip 12 is covered with a Velcro fastening element comprising a fabric strip 52 in which is embedded hook engaging means in the form of an array of plastic loops 54 arranged in rows and projecting from the surface of the strip 52. A complementary Velcro strip is attached to each of the hair pieces 48 and 50 this complementary strip comprising a fabric strip 56 in which is embedded an array of plastic hooks 58 arranged in a row or rows and projecting from the surface of the strip 56. When the Velcro strip of a selected hair piece 48 or 50 is pressed against the Velcro covering of the clip 12, the hooks 58 on the hair piece mesh with and grip the loops 54 on the clip, so that the hair piece is fastened to the mounted clip 12 and thus to the doll head 10. Since the plastic hooks and loops of the Velcro fastening assembly are flexible, they may be disengaged and unfastened merely by peeling the complimentary strips apart, so that the fastened hair pieces may be easily removed when desired.

The thickness of the clip 12 is substantially equal to the depth of the recessed groove 24, so that when the clip is snapped into said groove and permanently mounted therein, the outer surface of the clip 12 is flush and continuous with the outer surface of the doll head 10, as shown in FIG. 3, while the hooks 54 project above the surface of the doll head. After the clip 12 has been mounted in the groove 24, a permanent doll wig is secured to the head 10 by rooting hair 60 in the usual manner to the head. FIG. 3 shows only a portion of the doll hair, the remainder of the wig being omitted to reveal the location of the clip 12, but the rooting holes 62 indicating the area in which hair 60 is rooted up to hair line 64. The hair 60 is not rooted on the clip 12 itself, but is densely rooted around the clip. The rooted hair is curly and is just long enough to cover the band of Velcro on the clip 12, so that the rooted hair overlies and hides the clip and its Velcro covering from view, as shown in FIGS. 4 and 5.

The hair pieces provided with the doll may be of any of the styles currently used in fashion, and may, for example, be styled as ponytails, puffs of curls, chignons, pigtails, or the like. The hairpiece 48 illustrated in FIG. 1 is a fall which would be attached at the front of the head crown portion 16 to overlie the rooted hair at the top of the head, while the hairpiece 50 is a ponytail to be attached at the back of the head crown portion 16. Since the clip 12, with its Velcro covering extends centrally across the top of the crown and across the rear and sides of the crown, the clip provides areas at all necessary portions of the doll head for attachment of the auxiliary hair pieces. The enlarged clip portion 36 provides a wide area at the front of the crown for attachment of large hair pieces, as do the enlarged clip portions 40 at the sides of the crown.

As previously described, the hair 60 of the permanent doll wig overlies the clip 12. In use of the doll, when it is desired to attach one or more of the auxiliary hair pieces, a hair piece is positioned in alignment with a selected part of the clip 12, and the Velcro strip on the hair piece is pressed against the Velcro covering on the clip. The hooks 58 on the hairpiece penetrate through the hair 60 overlying the clip and engage and grip the loops 54 on the clip so that the hair piece adheres to the doll head in the position selected. The hair piece may be easily peeled off and removed when desired, and replaced by another hair piece.

It will be appreciated that the Velcro fastening elements on the clip and the hairpieces may be reversed, that is, the clip 12 may be covered with a Velcro fabric embedding hooks, and the hair pieces provided with Velcro strips having loops. The same removable attachment will be provided by this arrangement.

While a preferred embodiment of the invention has been shown and described herein, it is obvious that numerous omissions, changes and additions may be made in such embodiment without departing from the spirit and scope of the invention.

What is claimed is:

1. A doll adapted to receive interchangeable hair pieces, said doll comprising a doll head having a crown portion and a permanent wig formed of hair filaments covering said crown portion, hair piece mounting means secured to said doll head and having enlarged portions located at the front center and sides of said crown portions, an auxiliary hairpiece, and self-adhering fastening means including complementary hook and hook-engaging surfaces on said enlarged portions and said auxiliary hair piece for releasably attaching said hair piece to a selected enlarged portion, the hair filaments of said permanent wig overlying and concealing said enlarged portions and said auxiliary hair piece being removably attachable to said doll head by pressing the fastening means surface of said auxiliary hair piece against the fastening means surface on a selected enlarged portion through the hair filaments overlying the latter.

2. A doll according to claim 1 in which said mounting means comprises a clip including a first elongated band extending across the center of said crown from the front of said crown to the rear thereof, and a second elongated band formed integrally with the rear end of said first band and extending perpendicularly thereto across the rear and sides of said crown.

3. A doll according to claim 2 in which the front end of said first band terminates in an enlarged portion extending laterally from opposite sides of said first band at the forward portion of said crown.

4. A doll according to claim 3 in which said second elongated band terminates at each end in respective enlarged portions located at the sides of said crown.

5. A doll according to claim 2 in which said head is formed with a recessed groove sized to receive said clip, said groove having an upper section extending centrally over said crown portion and communicating at the rear of said head with a rear section disposed perpendicularly to said upper section and extending transversely across the rear of said head portion and partially around the sides of said head portion.

6. A doll according to claim 5 in which said clip is made of a plastic and is formed with a plurality of spaced locking tabs having spear-shaped ends, and in which said groove has a plurality of spaced apertures formed therein and sized and positioned to receive said locking tabs for locking said clip in inserted position within said groove.

7. A doll according to claim 6 in which said recessed groove has a depth substantially equal to the thickness of said clip, whereby when said clip is inserted in said groove the outer surface of said clip is flush with the outer surface of said doll head.

8. A doll according to claim 7 in which the outer surface of said clip is covered with a first self-adhering fastening array of gripping fastening elements projecting perpendicularly from the surface thereof, and said hairpiece is provided with a second self-adhering array of complementary gripping fastening elements projecting perpendicularly from the surface thereof.

9. A doll according to claim 7 in which the fastening elements of one of said self-adhering arrays comprises a plurality of loops and the fastening elements of the other self-adhering array comprises a plurality of hooks arranged to engage and releasably grip said loops when said arrays are pressed together.

10. A doll according to claim 9 in which said permanent wig covering said crown portion comprises filaments rooted in said crown and of sufficient lengths to cover over said clip and the fastening elements thereon.

* * * * *